United States Patent [19]

Klemm

[11] Patent Number: 4,619,050

[45] Date of Patent: Oct. 28, 1986

[54] APPARATUS FOR DRYING SHEET- OR WEB-LIKE MATERIALS WITH ULTRAVIOLET RADIATION

[76] Inventor: Gerhard Klemm, Am Rehwinkel 37, D-4800 Bielefeld 1, Fed. Rep. of Germany

[21] Appl. No.: 723,427

[22] Filed: Apr. 15, 1985

[51] Int. Cl.[4] ..... F26B 23/04

[52] U.S. Cl. ..... 34/4; 34/41; 34/68

[58] Field of Search ..... 34/4, 41, 155, 68, 1

[56] References Cited

U.S. PATENT DOCUMENTS 3,930,318 1/1976 Stelter et al. ..... 34/4
4,408,400 10/1983 Colapinto ..... 34/4

FOREIGN PATENT DOCUMENTS 2460706 7/1976 Fed. Rep. of Germany ..... 34/4
386840 1/1933 United Kingdom ..... 34/41

*Primary Examiner*—Larry I. Schwartz
*Attorney, Agent, or Firm*—Peter K. Kontler

[57] ABSTRACT

Apparatus for drying webs or sheets of moist material which issues from a printing machine and is transported continously or stepwise to be acted upon by ultraviolet light issuing from one or more lamps mounted at a level above the path of movement of the material. The lamp or lamps are pivotable, reciprocable and/or otherwise movable in and counter to the direction of movement of the material, toward and away from the material and/or transversely of the path. A cooling device is installed at a level below the path to directly contact or to indirectly remove heat from the material opposite the lamp or lamps.

28 Claims, 8 Drawing Figures

APPARATUS FOR DRYING SHEET- OR WEB-LIKE MATERIALS WITH ULTRAVIOLET RADIATION

BACKGROUND OF THE INVENTION

The present invention relates to apparatus for drying webs or sheets of paper, metallic or plastic foil, cardboard, woven or non-woven textile materials and the like. More particularly, the invention relates to improvements in apparatus for drying such webs or sheets with ultraviolet radiation.

Drying apparatus are normally utilized in conjunction with printing machines, such as screen printing machines, to expel moisture from the material which issues from the machine. These drying apparatus normally employ a large number of discrete ultraviolet lamps because the conicity of the beam of radiation issuing from an ultraviolet lamp is relatively small. The ulitization of a large number of lamps creates problems, particularly since the purpose of the lamps is often twofold, i.e., they must dry the material which issues (either continuously or intermittently) from a printing or other treating machine, and they must also ensure adequate polymerization of the applied substance or substances (such as one or more coloring agents). Moreover, it is often necessary to subject the materials to a relatively long-lasting drying action (this depends on the nature and quantity of substances which are applied to the material in a screen printing or other treating machine). While the material which issues from a screen printing machine could advance continuously, it is customary to advance such material stepwise, especially if the machine employs flat stencils or screens. This renders it necessary to deactivate the ultraviolet lamps during each interval of dwell of the treated material in order to prevent overheating and the resulting charring, burning, shrinkage and other undesirable consequences of the drying operation.

The likelihood of overheating the material in a conventional drying apparatus which employs ultraviolet lamps is especially pronounced because the generation of ultraviolet radiation is invariably accompanied by the generation of infrared rays which produce substantial amounts of heat. Therefore, many types of materials cannot be treated in heretofore known drying apparatus which utilize sources of ultraviolet radiation.

Attempts to avoid the deleterious effects of infrared rays issuing from sources of ultraviolet radiation include the provision of mirrors which are supposed to reflect ultraviolet light and the utilization of blowers which direct streams of a suitable coolant across the path of deflected radiation so as to remove a certain percentage of heat. A drawback of such proposal is that the efficiency of the drying apparatus is reduced considerably and that the energy consumption of the apparatus (in comparison to its output) is excessive. Moreover, the utilization of blowers adjacent to the path of movement of the web or sheet of material issuing from a screen printing or like machine brings about the drawback that the layer or layers of coloring matter on the material rapidly develop a skin which interferes with predictable drying and, at the very least, prolongs the drying operation. The skin constitutes an envelope which prevents the expulsion of moisture from the layer or layers therebelow.

A further drawback of presently known drying apparatus which employ a large number of ultraviolet lamps or burners is that the cost of such apparatus is prohibitive. The reason is that the initial cost of each lamp is considerable as well as that the useful life of an ultraviolet lamp is relatively short. The short useful life of ultraviolet lamps is attributable, to a certain degree, to the fact that the neighboring lamps adversely influence each other.

An additional drawback of presently known drying apparatus which employ large numbers of ultraviolet lamps is that it is difficult or impossible to properly array and orient the lamps so as to ensure uniform treatment of each and every portion of that length of the material which is exposed to ultraviolet radiation. The reason is that the beams of radiation issuing from neighboring lamps partially overlap each other so that certain portions of the material to be dried are invariably exposed to radiation of much greater intensity than the remaining portions of the material. Not only the material of an intermittently or continuously running web or sheet of paper, textile material or the like reacts differently to exposure to radiation of different intensity but this applies with equal force to the behavior of coloring media which are applied to such material in a screen printing or like machine.

Intensive heating of certain portions of or the entire material that issues from a screen printing or other treating machine is likely to damage the material in a number of not readily detectable ways. For example, overheating can entail a weakening of the affected portions of the material in a manner which is not immediately detectable. Thus, the overheated portions of the material are likely to become brittle so that their useful life is much shorter than that of the remaining portions of the same material.

Still another drawback of presently known drying apparatus which employ batteries of ultraviolet lamps is that their output is relatively low. This is due primarily to the need for frequent replacement of one or more lamps. As stated above, the useful life of an ultraviolet lamp is relatively short and, if the apparatus employs a large number of such lamps, it is likely to be idle for extended intervals of time or, more accurately stated, the apparatus must be arrested again and again whereby the total number of down times adds up to a substantial part of a shift. The failure of a single lamp invariably necessitates a stoppage of the apparatus and replacement of the defective lamp.

British Pat. No. 386,840 discloses a drying apparatus which is shiftable transversely of the path of the material to be dried. Such shiftability is proposed for the purpose of ensuring that the lamps will be moved to optimum positions relative to the material of the web or sheet. The patent proposes the utilization of guide rails to facilitate the transport of drying apparatus to a position wherein radiation issuing from the lamps is intercepted by a plate so that an operator can extend her or his hand into the apparatus in order to ascertain the progress of the drying operation. Once the apparatus is in actual use, the lamps or burners are at a standstill and direct radiation in a particular direction which cannot be changed. This brings about the same drawbacks as those of the aforedescribed stationary drying machines.

OBJECTS AND SUMMARY OF THE INVENTION

An object of the invention is to provide a novel and improved apparatus which can uniformly heat all portions of a continuously or intermittently advancing web- or sheet-like material with substantial savings in energy and without damaging the material.

Another object of the invention is to provide a relatively simple and inexpensive drying apparatus which can be used in conjunction with available printing and like machines irrespective of whether the machines discharge the material continuously or at regular or irregular intervals.

A further object of the invention is to provide the apparatus with novel and improved means for preventing overheating the material of a web or sheet in the course of the drying operation.

An additional object of the invention is to provide the apparatus with novel and improved means for preventing overheating of the material of a web or sheet when the web or sheet comes to a halt.

Still another object of the invention is to provide an apparatus which ensures rapid and predictable setting of polymerizable substances if such substances are applied to an intermittently or continuously running web or sheet in a printing or other treating machine.

A further object of the invention is to provide an apparatus which can properly treat wide, narrow, thick, thin, readily flexible or relatively stiff materials and which can be used for controlled expulsion of selected percentages of moisture from such materials.

Another object of the invention is to provide a novel and improved method of drying a web or sheet of moisture-containing material on its way from a printing or other treating machine.

An additional object of the invention is to provide the apparatus with novel and improved means for simultaneously heating and cooling intermittently or continuously running webs or sheets of paper, cardboard, metallic or plastic foil, woven or non-woven textile material or the like.

A further object of the invention is to provide an apparatus whose output is higher than that of heretofore known drying apparatus.

The invention is embodied in an apparatus for drying moisture-containing web- or sheet-like materials, particularly for drying coated or impregnated sheets or webs of paper, textile material or the like which issues from a treating means such as a printing machine (e.g., a screen printing machine). The apparatus comprises means for advancing a material to be dried along a predetermined path and in a predetermined direction, at least one source of ultraviolet radiation which is adjacent to one side of the path, and means for moving the source with reference to the path. The moving means can comprise a fluid-operated (hydraulic or pneumatic) cylinder and piston unit for reciprocating the source of radiation in and counter to the predetermined direction. Alternatively, the reciprocating means for the source can comprise an electric or other suitable motor whose output element is connected with the source by a crank mechanism, a feed screw, a pivotable lever or other suitable motion transmitting means. The cylinder and piston unit or the crank drive can transmit motion to a carriage which supports the source and is preferably reciprocable relative to the path along elongated straight or arcuate guide means (e.g., one or more stationary rails). The moving means can be designed to reciprocate or otherwise move the source or sources of radiation along a second path which is at least substantially parallel to the predetermined path. The arrangement may be such that the advancing means is designed to intermittently transport the material through first distances (preferably through distances of identical length) and the moving means includes means for moving (e.g., reciprocating) the source or sources through second distances each of which matches or approximates a first distance.

The apparatus can further comprise a stationary receptacle or housing which is adjacent to the one side of the predetermined path and has an open side facing such path. The source or sources of radiation are installed in and are movable relative to the housing. That portion of the housing which is adjacent to the path for the material to be dried can be provided with a passage for such material.

The moving means can also comprise at least one lever which is pivotable about a predetermined axis and has an arm supporting the source or sources of radiation, and means for pivoting the lever or levers.

The apparatus preferably further comprises means for cooling the material, and such cooling means is adjacent to the other side of the predetermined path, preferably opposite the source or sources of radiation. The arrangement is preferably such that the source or sources are located at a level above and the cooling means is disposed at a level below the predetermined path. The cooling means can comprise a material-contacting cooling surface which can be a composite surface consisting of several contiguous or spaced-apart sections on discrete profiled (e.g., U-shaped) cooling members each of which contains a heat exchanging coil or a portion of a continuous heat exchanging coil serving as a means for withdrawing heat from the material-contacting surface or surfaces. The cooling means can further comprise (in addition to or in lieu of the aforementioned cooling member or members) one or more cooling elements having means for exerting a directed cooling action upon that side of the material in the predetermined path which faces away from the source or sources of radiation. A typical example of a cooling element which can exert a directed cooling action is a blower, and such blower may be used in conjunction with a shroud or nozzle which directs one or more streams of air or another cooling medium against one or more selected portions of the material in the predetermined path. In many instances, the cooling means will comprise at least one cooling member which is in direct contact with the material in the predetermined path and at least one device (e.g., one or more heat exchanging coils or one or more blowers) for removing heat from the cooling member or members. If the source or sources of radiation are caused to reciprocate along an arcuate path (e.g., if the carriage or carriages for the source or sources are reciprocated along one or more arcuate guide rails), the cooling member or members of the cooling means can be formed with one or more arcuate surfaces whose curvature at least approximates that of the guide rail or guide rails for the carriage or carriages. Such surface or surfaces are preferably convex surfaces and at least a portion of at least one of these surfaces can form part of a cylindrical surface (i.e., the curvature of such portion or portions of one or more surfaces can be constant). It is also possible to employ cooling means which comprises or constitutes a suction chamber with an apertured wall immediately or closely adjacent to or actually contacting the material in the predetermined path. The entire cooling means can consist exclusively of one or more heat exchanging coils and/or one or more blowers (i.e., air circulating means).

The advancing means for the material to be dried can comprise a plurality of rollers over which the material is trained and at least one of which can have an evacuated space surrounded by a wall which contacts the material. The advancing means can be designed to advance the material continuously and/or intermittently.

As mentioned above, the moving means can include means for reciprocating the source or sources, e.g., by means of a fluid-operated motor or by means of a motor having a rotary output element and a crank mechanism or another motion transmitting system between the rotary output element of the prime mover and the carriage or carriages for one or more sources of radiation. It is also possible to employ a moving means which pivots the source or sources about a predetermined axis, e.g., an axis which is located at the one side of the predetermined path or an axis which is located at the opposite side of such path.

In accordance with a further embodiment of the invention, the moving means can comprise means for reciprocating or otherwise moving the source or sources between a plurality of positions at different distances from the predetermined path. Such reciprocating or moving means can comprise a fluid-operated motor and the source or sources are preferably located at a level above the predetermined path so that the source or sources can be moved up and down (i.e., away from and nearer to the one side of the predetermined path). For example, the aforementioned housing can contain a second housing which is also formed with an open side facing the one side of the predetermined path, and the source or sources of radiation can be installed in the second housing which is then connected with a means for reciprocating it in and relative to the stationary housing.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
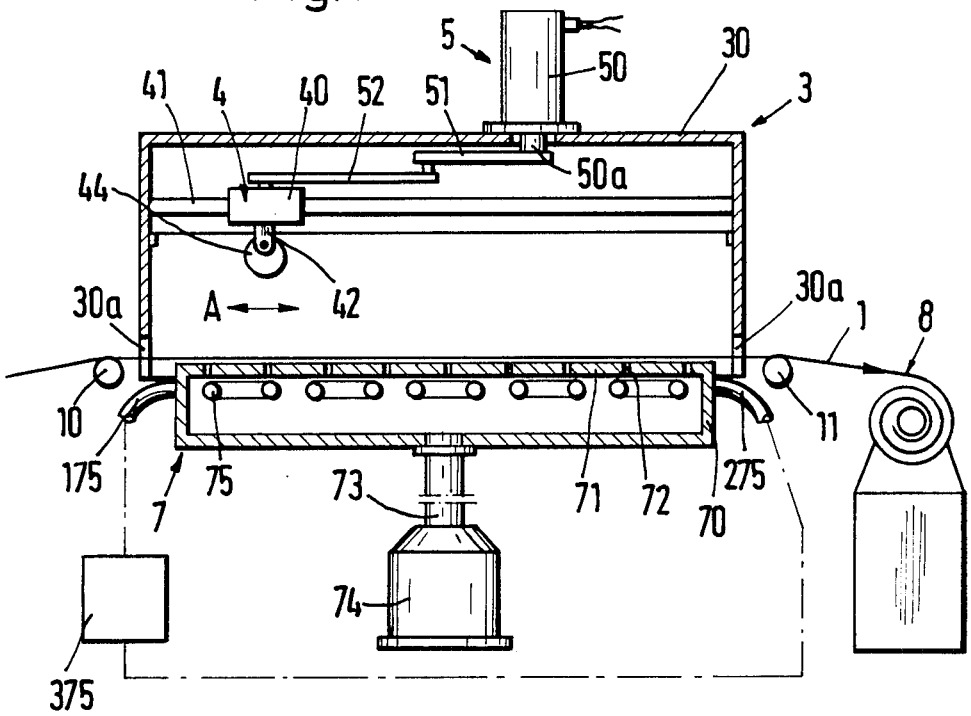
FIG. 1 is a somewhat schematic partly side elevational and partly longitudinal vertical sectional view of an apparatus which embodies one form of the invention and wherein a single source of radiation is reciprocated along a straight horizontal path by a motor through the medium of a crank mechanism.

Referring first to FIG. 1, there is shown an apparatus which is designed to remove moisture from a web 1 of paper, cardboard, foil, woven or non-woven textile material or the like while the material advances (either continuously or intermittently) along a substantially horizontal path. The means for advancing the web 1 along such path (in a direction to the right, as viewed in FIG. 1) comprises a motor-driven takeup reel 8 which convolutes successive increments of the web upon completed drying of such increments. The web 1 is supplied by a second reel (not shown) which is located to the left of the structure shown in FIG. 1 and upstream of a printing machine (see the machine 2 in FIG. 3) which treats the web in a manner that renders it necessary to dry the material prior to storing it in the form of a roll or the like. The printing machine 2 can constitute a continuous or discontinuous screen printing machine of any known design. If the machine 2 operates discontinuously, the means for advancing the material of the web 1 can include one or more conventional grippers or jaws which draw the web from the printing machine in a series of successive operations so that the web 1 is intermittently advanced through (first) distances of predetermined length. The web advancing means of the apparatus which is shown in FIG. 1 further comprises a plurality of rolls including the rolls 10 and 11 or analogous rotary elements over which the web 1 is trained on its way from the supply reel toward the takeup reel 8.

In accordance with a feature of the invention, the apparatus comprises novel and improved means 3 for drying the web 1 in its path between the rolls 10 and 11 by a source 44 of ultraviolet radiation (hereinafter called lamp for short) which is movably installed in a stationary housing 30 having an open underside facing the upper side of the path for the web 1. The housing 30 is preferably made of or contains a suitable heat-insulating material in order to reduce losses in heat energy. The lowermost portion of the housing 30 defines a passage (note the cutouts 30*a* in the transversely extending sidewalls of the housing) which enables the web portion between the rolls 10 and 11 to advance through the housing at a level above a cooling device 7.

The lamp 44 forms part of a unit 4 which is reciprocable in the housing 30 along an elongated path that is at least substantially parallel to the path of movement of the web 1 between the rolls 10 and 11. The unit 4 is reciprocable (arrow A) in and counter to the direction of continuous or intermittent advancement of the web 1 and such unit further comprises a carriage 40 having one or more downwardly extending lamp-supporting arms 42. The means 5 for moving the lamp 44 comprises an electric motor 50 which is mounted on the top wall of the stationary housing 30 and whose rotary output element 50*a* extends into the interior of the housing to rotate a crank arm or link 51 forming part of a crank mechanism which further includes a connecting rod 52 articulately coupled to the carriage 40 and to the link 51. When the motor 50 is on, the link 51 causes the connecting rod 52 to reciprocate the carriage 40, and hence the lamp 44, along an elongated straight path which is defined by one or more elongated guide rails 41. The rail or rails 41 are mounted in the housing 30.

When the apparatus is in use, the motor 50 is on continuously so as to guarantee that the lamp 44 performs its reciprocatory movements in the directions indicated by the arrow A irrespective of whether the web 1 is in motion or at a standstill. This ensures that the web 1 (or any portion of the web) below the path of movement of the lamp 44 is not subjected to an excessive amount of the infrared part of radiation issuing from the lamp 44.

The cooling unit 7 below the housing 30 comprises a suction chamber 70 having a perforated or otherwise apertured top wall 71 which can be said to constitute a contact cooling member because it directly contacts the underside of the web 1 below the path of reciprocatory movement of the lamp 44. The plate-like top wall 71 is formed with suitably distributed holes 72 which act as suction ports and enable the wall 71 to attract the adjacent portion of the uncoated side of the web 1 under the action of a suction generating device 74 whose suction intake is connected to the chamber 70 by a conduit 73 (e.g., a flexible hose).

The suction chamber 70 contains one or more heat exchanging coils 75, e.g., a single elongated coil of meandering shape whose inlet 175 is connected to the outlet of a pump 375 or other suitable circulating means for a gaseous or liquid cooling medium. The coil 75 is immediately or closely adjacent to the underside of the top wall 71 and serves to remove heat which is transmitted to the wall 71 by the web 1. The outlet 275 of the coil 75 is connected to the intake of the pump 375 which further comprises means (not specifically shown) for removing heat from the circulating cooling medium. For example, the pump 375 can contain a suitable heat exchanger.

The provision of a cooler which utilizes a suction chamber with a plate-like member whose top surface is in direct heat-removing contact with the material to be dried is especially desirable and advantageous if the means for advancing the web along its path comprises an intermittently driven takeup reel 8 and the aforediscussed gripper or grippers which serve to draw the material of the web from a screen printing machine.

Figure 2:
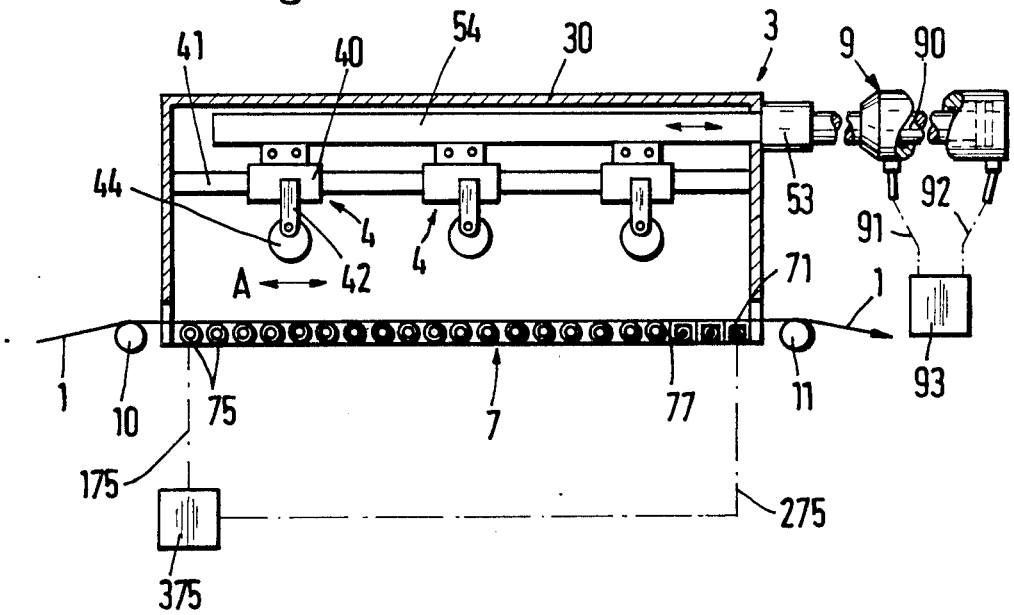
FIG. 2 is a similar view of a modified apparatus wherein three radiation sources are reciprocable by a double-acting fluid-operated cylinder and piston unit and the path of the material to be dried extends at a level above a modified cooling means.

FIG. 2 shows a modified apparatus wherein all such parts which are identical with or clearly analogous to the corresponding parts of the apparatus of FIG. 1 are denoted by similar reference characters. This also holds true for the embodiments which are shown in FIGS. 3, 4, 5, 6 and 7–8. The apparatus of FIG. 2 comprises several lamps 44 each of which forms part of a discrete unit 4 further including a carriage 40 with one or more downwardly extending lamp-supporting arms 42. The radiation issuing from the lamps 44 of FIG. 2 impinges directly upon the upper side of the web 1, the same as in the embodiment of FIG. 1. The carriages 40 are or can be equidistant from each other and are attached to an elongated supporting member 54 which can be said to constitute the piston rod of a cylinder and piston unit 9 forming part of a means for reciprocating the lamps 44 relative to the stationary housing 30 of the web drying means 3 and relative to the path of movement of the web 1 along the rolls 10, 11 and toward the takeup reel, not shown. The piston rod 54 is reciprocable in a tubular guide 53 which is affixed to the housing 30, and the carriages 40 are reciprocable along one or more stationary guide rails 41 in the interior of the housing. The rail or rails 41 define for the carriages 40 a path which is parallel to the path of movement of the web 1 from the roll 10 toward the roll 11. That portion of the piston rod 54 which extends into the cylinder of the unit 9 is denoted by the character 90. The chambers of the cylinder of the unit 9 receive pressurized fluid from a source 93 by way of conduits 91 and 92. The controls which regulate the admission of pressurized fluid into and the evacuation of fluid from the chambers of the cylinder in the unit 9 are not specifically shown in the drawing.

The apparatus of FIG. 2 comprises a modified cooling device 7 with several discrete heat exchanging coils 75 or a continuous heat exchanging coil partially surrounded by profiled (preferably U-shaped) sections 77 of a composite cooling member whose upper side or surface is in direct contact with the underside of the web 1 between the rolls 10 and 11, i.e., below that (open) side of the housing 30 which faces the path for the web. It is clear that the illustrated cooling members 77 can be replaced with otherwise profiled cooling members (e.g., with members having an H-shaped or an I-shaped cross-sectional outline). The insertion of the coil or coils 75 into the profiled members 77 contributes to compactness of the cooling device 7 and ensures highly satisfactory removal of heat from the web 1 in the region below the path of reciprocatory movement of the lamps 44.

The operation of the apparatus which is shown in FIG. 2 is as follows: The controls for the flow of pressurized fluid in the conduits 91, 92 are designed to ensure that the cylinder and piston unit 9 reciprocates the lamps 44 at a preselected speed and at regular intervals in directions which are indicated by the double-headed arrow A, i.e., in and counter to the direction of continuous or intermittent advancement of the web. The frequency of reciprocatory movement of the lamps 44 along the rail or rails 41 is preferably variable so that the heating action can be selected with a view to ensure adequate drying of successive increments of the continuously or intermittently running web 1 before such increments are convoluted onto the takeup reel.

Figure 3:
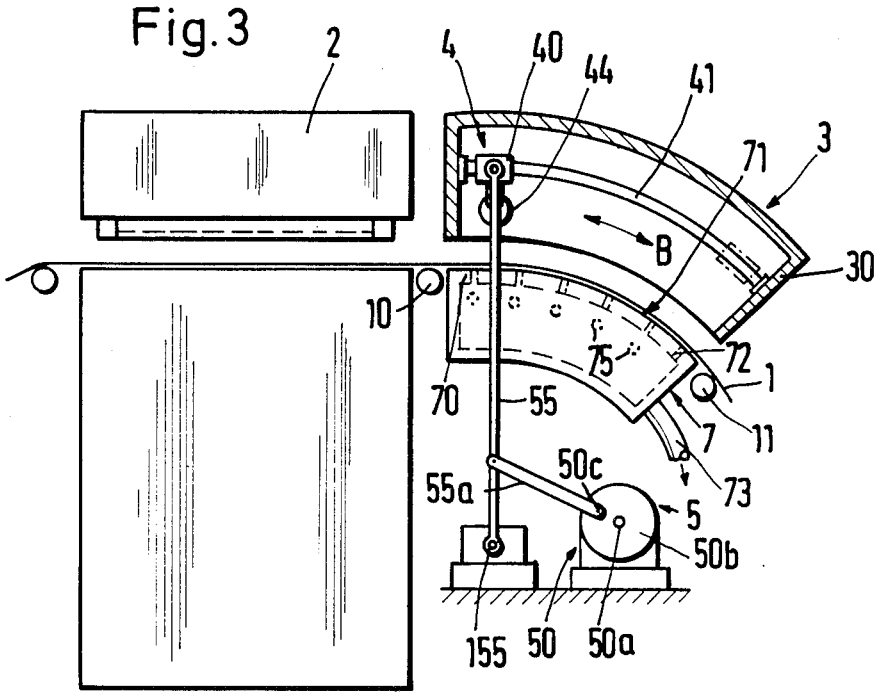
FIG. 3 is a somewhat schematic partly side elevational and partly longitudinal vertical sectional view of a third apparatus wherein a single radiation source is reciprocable along an arcuate path by a pivotable lever and the cooling means includes a convex material-contacting surface.

The apparatus of FIG. 3 comprises a modified web drying means 3 with an arcuate stationary housing 30 for one or more arcuate guide rails 41. The carriage 40 for the lamp 44 is reciprocable along the arcuate guide rail 41 by a modified moving means 5 including an elongated lever 55 which is pivotable at 155 (i.e., about a fixed axis located at a level below the path of movement of the web 1 from the printing machine 2 toward the takeup reel). The means for pivoting the lever 55 comprises a prime mover 50 (e.g., an electric motor) whose output element 50*a* carries a disc 50*b* having an eccentric pin 50*c* for one end of a link 55*a* the other end of which is articulately connected to an intermediate portion of the lever 55. The means for moving the lamp 44 along an arcuate path which is defined by the guide rail or rails 41 can comprise two levers 55, one at the front side and the other at the rear side of the path of movement of the web 1, as viewed in FIG. 3.

The underside of the web 1 between the rolls 10 and 11 is in direct contact with the convex surface of a top wall 71 forming part of a suction chamber 70 which is connected to a suction generating device (not shown) by a conduit 73. The top wall or cooling member 71 has a plurality of suitably distributed suction ports 72 in the form of holes which attract the web 1 to the convex surface of the top wall 71 when the suction generating device is in operation to draw air from the interior of the suction chamber 70. The manner in which the top wall 71 of the suction chamber 70 is cooled by one or more heat exchanging coils 75 of the cooling device 7 is or can be the same as described in connection with and as shown in FIG. 1.

The machine 2 need not necessarily constitute a screen printing machine. For example, such machine can be used to apply to the web one or more coloring agents, one or more chemicals, or one or more layers of a material which adheres to the upper side of the web 1 and is polymerized or otherwise treated as a result of exposure to ultraviolet radiation issuing from the lamp 44.

The apparatus of FIG. 3 can be used with particular advantage for the drying of an intermittently advanced web. Thus, the web 1 comes to a standstill at regular or irregular intervals and that portion thereof which overlies the convex surface of the top wall 71 is then treated by exposure to radiation issuing from the lamp 44. It is clear that the lever or levers 55 can pivot one or more carriages 40 and/or that the illustrated carriage 40 of the unit 4 can support a battery of two or more suitably distributed lamps 44. The operation of the web drying means 3 is synchronized with the operation of the printing machine 2 to ensure that the drying times are not too short or too long and that the apparatus can readily process the entire output of the machine 2 while the latter is operated at a maximum speed or at any selected lower speed.

Figure 4:
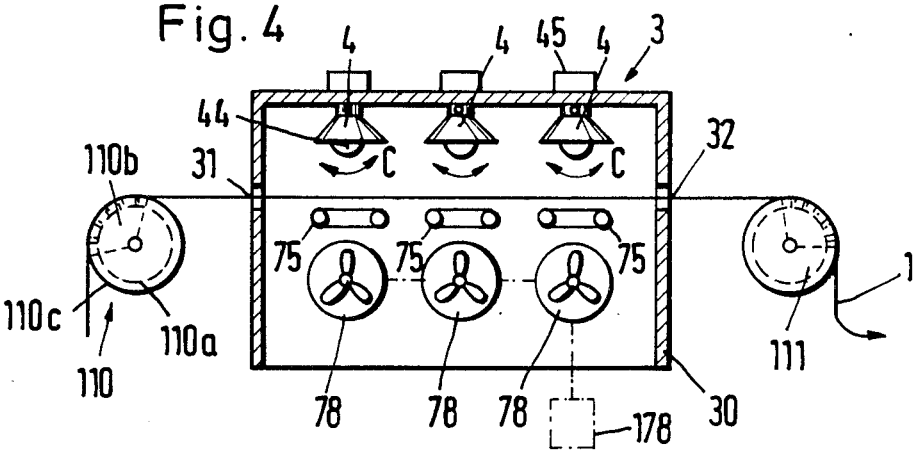
FIG. 4 is a fragmentary partly elevational and partly longitudinal vertical sectional view of a fourth apparatus wherein each of several radiation sources is pivotable by a discrete prime mover and the cooling means comprises a set of blowers and one or more heat exchanging coils.

Referring to FIG. 4, there is shown a further apparatus wherein the web drying means 3 comprises a modified housing 30 having cutouts 31, 32 for the intermittently or continuously running web 1. That part of the housing 30 which extends downwardly beyond the horizontal path of the web 1 can be said to constitute an extension located at a level below the open side of the housing and serving to partially or substantially completely confine a modified cooling device. The housing 3 accommodates three discrete units 4 each of which includes at least one lamp 44. The means for moving the lamps 44 relative to the housing 30 and relative to the path of movement of the web 1 comprises discrete prime movers 45 each of which is designed to pivot the respective lamp 44 back and forth as indicated by the arrows C, i.e., about an axis which is located at a level above the web. Each of the prime movers 45 can operate not unlike the motor for the windshield wipers in a motor vehicle.

The rolls 110 and 111 of the apparatus which is shown in FIG. 4 can be said to constitute vacuum rolls each of which has a stationary cylindrical inner wall (see the wall 110*a*) surrounding an evacuated space (see the space 110*b*) and being surrounded by a foraminous cylindrical shell (see the shell 110*c*) whose pores or holes act as suction ports while in register with the evacuated space. The construction of the roll 111 is preferably identical with that of the roll 110. Rolls which can be used in the apparatus of the present invention are described, for example, in commonly owned U.S. Pat. No. 4,249,688 whose disclosure is incorporated herein by reference.

The purpose of the vacuum rolls 110, 111 is to tension the web portion therebetween so that such portion of the web can advance through the cutouts 31, 32 of the housing 30 without touching the housing and/or the constituents of the cooling device. This cooling device comprises one or more heat exchanging coils 75 which can be connected with a pump and a heat exchanger in a manner as described with reference to FIG. 1, and one or more blowers 78 driven by a common prime mover 178 (indicated by phantom lines) and serving to direct currents of cooling air against the underside of the web 1 between the cutouts 31, 32 of the passage which is defined by the housing 30. The arrangement is preferably such that the blowers 78 direct currents of cool air through the adjoining coils 75 and against the corresponding portion of the web 1 between the vacuum rolls 110 and 111. It has been found that the cooling device of FIG. 4 is also highly effective in spite of the fact that none of its constituents come into bodily contact with the web 1. The cooling devices 7 of FIGS. 1 to 3 exhibit the advantage that the web 1 can transmit heat directly to one or more cooling members which are in bodily contact therewith. On the other hand, the cooling device which is shown in FIG. 4 exhibits the advantage that it can be used in conjunction with the treatment of highly sensitive materials which should not be contacted at all on their way from the supply reel to the takeup reel.

Figure 5:
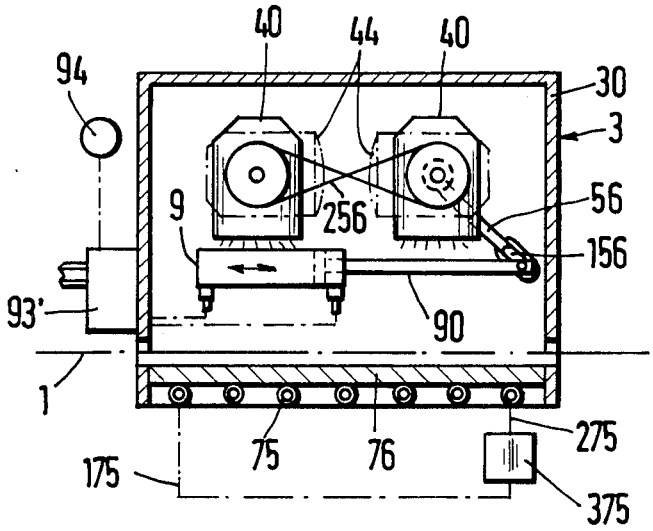
FIG. 5 is a similar view of a fifth apparatus wherein the radiation sources are pivotable by a common prime mover so that they face toward or away from the adjacent side of the path for the material to be dried.

FIG. 5 shows a further apparatus wherein the path for the web 1 extends along and close to or in actual contact with the upper side of a plate-like cooling member 76 at a level closely or immediately above one or more heat exchanging coils 75 and within the confines of that portion of the stationary housing 30 which extends downwardly beyond the path for the web. The upper portion of the housing 30 accommodates a fluid-operated motor 9 in the form of a cylinder and piston unit whose piston rod 90 is articulately connected with a link 56 for transmission of motion to the carriages 40 of two drying units. Each such unit further comprises a lamp 44. The link 56 has an elongated slot 156 for a pin at the respective end of the piston rod 90. An 8-shaped belt 256 transmits motion from the right-hand carriage 40 to the left-hand carriage 40 of FIG. 5 so as to enable the lamps 44 to turn about two discrete horizontal axes between the solid-line and the phantom-line positions of FIG. 5. When in solid-line positions, the lamps 44 direct radiation against the upper side of the web portion in the path above the plate-like cooling member 76. When in phantom-line positions, the lamps 44 direct radiation toward each other. The axes of the pulleys which are driven by the belt 256 extend transversely of the path of movement of the web 1.

In FIG. 5, the reference character 93' denotes a control device which is installed in the path of flow of a fluid medium between a source 94 of pressurized fluid and the chambers of the cylinder in the unit 9. This enables the cylinder to move the piston rod 90 back and forth and to thereby pivot the lamps 44 between their two end positions. The source 94 can constitute an air compressor.

An advantage of the apparatus of FIG. 5 is that intervals of heating the web 1 alternate with intervals during which the web is not heated (namely, when the lamps 44 assume the phantom-line positions of FIG. 5). It has been found that the apparatus of FIG. 5 is also capable of ensuring highly predictable and uniform expulsion of moisture from the material of the web and that the web is highly unlikely to be damaged by any part of radiation issuing from the lamps 44.

Figure 6:
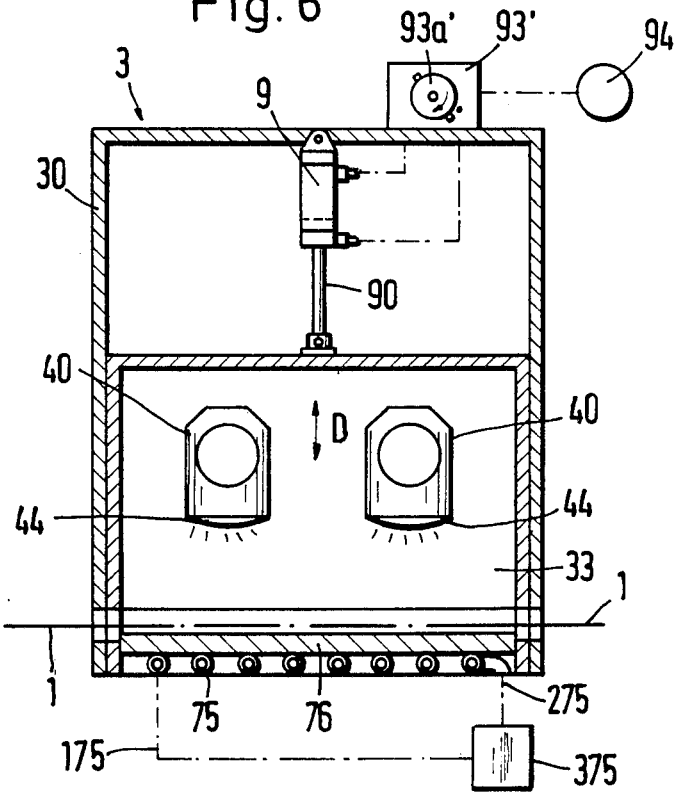
FIG. 6 is a fragmentary partly side elevational and partly vertical sectional view of a sixth apparatus wherein a stationary housing confines a second housing which contains several radiation sources and is reciprocable in the stationary housing toward and away from the path of the material to be dried.

The apparatus of FIG. 6 is similar to that of FIG. 5 except that the carriages 40 are non-rotatably mounted in a housing 33 which is reciprocable in the stationary housing 30 of the web drying means 3 so that it can move the lamps 44 toward and away from the path of movement of the web 1 above the plate-like cooling member 76. The directions in which the lamps 44 can be moved nearer to and further away from the web 1 are indicated by a double-headed arrow D. The open underside of the housing 33 faces the path for the web 1. The means for reciprocating the housing 33 relative to the housing 30 comprises a cylinder and piston unit 9 whose piston rod 90 is attached to the top wall of the housing 33, whose cylinder is mounted on the top wall of the housing 30, and which receives pressurized fluid or discharges fluid by way of suitable controls 93' serving to regulate the flow of pressurized fluid from a source 94. If the fluid is compressed air, spent fluid can be discharged from the cylinder chambers of the unit 9 without returning into the source 94.

The cooling member 76 can be replaced by a suction chamber, such as the suction chamber 70 of FIG. 1, or by a set of blowers and/or heat exchanging coils.

The apparatus of FIG. 6 exhibits the advantage that the heating action of the lamps 44 upon the material of the web 1 can be intensified or reduced to a desired extent. Moreover, the rate of reciprocation of the housing 33 relative to the housing 30 can be readily selected in such a way that the infrared portion of the radiation issuing from the lamps 44 cannot cause any shrinkage of and/or otherwise adversely influence the material of the web 1.

The control device 93' for the admission of pressurized fluid from the source 94 into the cylinder chambers of the unit 9 can include an electric clock with a reversible rotary disc **93*a'* which causes the unit 9 to reverse the direction of movement of the housing 33 whenever the disc 93*a'*** reaches one of its two end positions.

Figure 7:
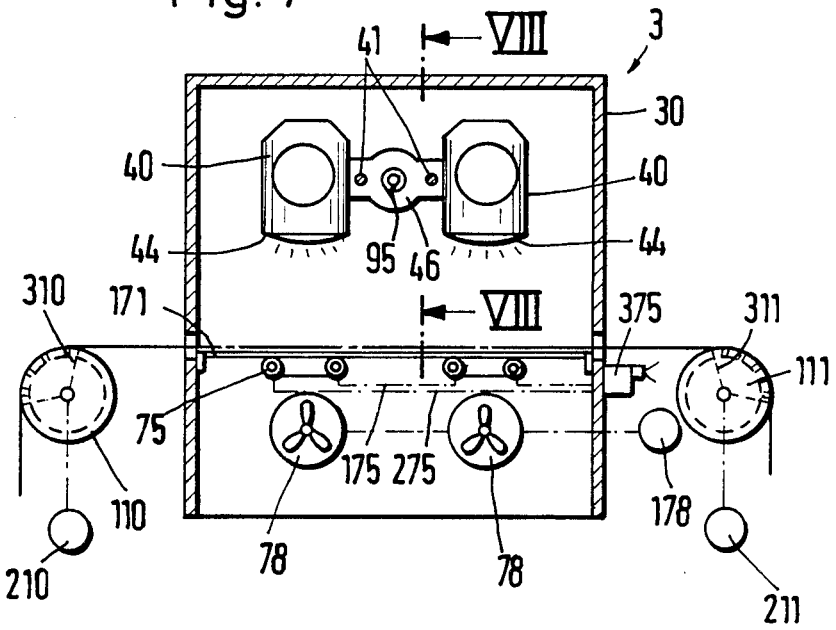
FIG. 7 is a similar view of a seventh apparatus wherein the sources of radiation are movable transversely of the path of movement of the material to be dried.
Figure 8:
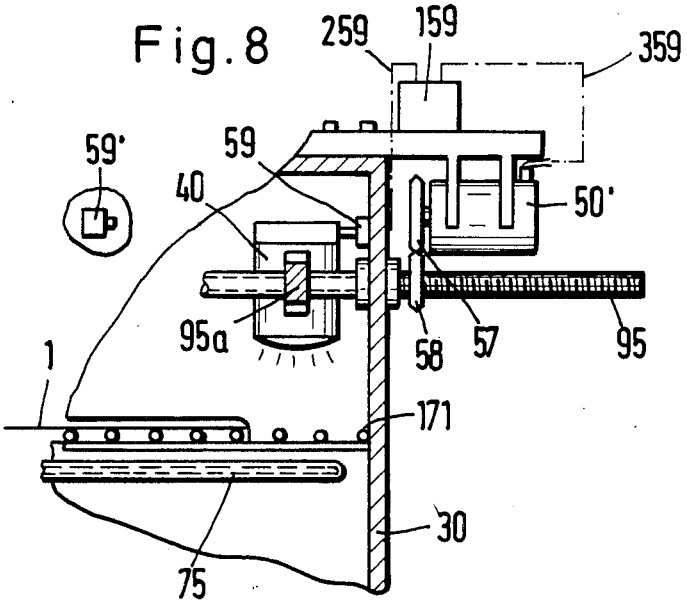
FIG. 8 is an enlarged fragmentary sectional view as seen in the direction of arrows from the line VIII—VIII of FIG. 7.

FIGS. 7 and 8 show a further apparatus wherein the means for advancing the web 1 along its path again comprises two vacuum rolls 110, 111 of the type disclosed in the aforementioned commonly owned U.S. Pat. No. 4,249,688. The evacuated spaces 310, 311 of these rolls correspond to the evacuated space **110*b* of the roll 110 of FIG. 4. The means for evacuating air from the spaces 310, 311 are respectively shown at 210 and 211**.

The housing 30 accommodates two carriages 40 for discrete lamps 44. The lamps 44 can be fully confined in the interior of the respective carriages 40, i.e., their lowermost portions can be located at a level above the open undersides of the carriages. Portions of lamps 44 are visible in FIGS. 7 and 8 only for the sake of convenient visualization of their locations. The carriages 40 are connected to each other by a bridge 46 which is reciprocable along two elongated parallel guide members 41 extending at right angles to (i.e., transversely of) the path of continuous or intermittent movement of the web 1 above a cooling member 171.

The means for reciprocating the bridge 46 (and hence the carriages 40 and their lamps 44) along the guide members 41 comprises a feed screw 95 mating with a nut **95*a* of the bridge 46 and carrying a gear 58 in mesh with a gear 57 on the output element of a reversible electric motor 50'. The motor 50' is in circuit with two limit switches 59, 59' which are located in the path of movement of one of the parts which are reciprocable along the guide members 41, and the limit switches are spaced apart in such a way that the carriages 40 complete strokes of preselected length before the motor 50' receives a signal to reverse the direction of rotation of the feed screw 95. The limit switches 59 and 59' can also serve to simply arrest the motor 50' so that the motor must be started again by means other than the limit switches when the lamps 44 are to move relative to the housing 30. A time-delay unit 159 can be provided to maintain the motor 50' in a state of idleness for a certain interval of time in response to each actuation of one of the limit switches 59, 59'. FIG. 8 shows an electrical connection 259 between the limit switch 59 and the time-delay unit 159 as well as an electrical connection 359 between the unit 159 and the motor 50'**.

The cooling device of the apparatus which is shown in FIGS. 7 and 8 comprises the aforementioned cooling member 171 in the form of a grate 171 whose upper side may but need not be in direct contact with the underside of the web 1. The underside of the grate 171 is adjacent to one or more heat exchanging coils 75 wherein a suitable fluid medium is circulated in the same way as described in connection with FIG. 1 (see the inlet 175, the outlet 275 and the pump 375 with heat êxchanger means or the like). FIG. 7 further shows two blowers 78 which are driven by a motor 178 and can serve as a means for subjecting the underside of the web 1 to a directed cooling action of one or more currents of air ascending through the adjacent coils 75.

The rotary cylindrical shells of the vacuum rolls 110, 111 are also driven, preferably in a manner as disclosed in the aforementioned commonly owned U.S. Pat. No. 4,249,688.

The operation of the apparatus which is shown in FIGS. 7 and 8 is as follows:

The motor 50' is started when the lamps 44 are turned on so that the feed screw 95 begins to rotate and moves the bridge 46 with the carriages 40 and lamps 44 in a direction to the left, as viewed in FIG. 8, until the bridge or a part thereon strikes the limit switch 59'. The limit switch 59' is caused to reverse the direction of rotation of the motor 50' and feed screw 95 so that the bridge 46 moves back toward the position of FIG. 8 in which the limit switch 59 is actuated to initate a shorter- or longer-lasting stoppage of the motor 50' by way of the time-delay unit 159. Alternatively, the limit switch 59 can be caused to immediately reverse the direction of rotation of the motor 50' so that the bridge 46 is again moved toward the limit switch 59'.

The improved apparatus is susceptible of many additional modifications. For example, the suction chamber 70 of the apparatus which is shown in FIG. 1 can contain one or more blowers (such as the blowers 78). All that counts is to ensure adequate cooling of the material of the web 1 while the web is subjected to the action of rays issuing from one or more ultraviolet lamps 44. Adequate cooling is highly desirable in most instances because it greatly reduces the likelihood of deformation of and/or other damage to the web as a result of heating. At the same time, the rays (including a certain percentage of infrared rays) issuing from one or more lamps can effect a rapid and highly predictable drying of the web.

It is also possible to impart to the lamp or lamps 44 a composite movement having a component in the direction of advancement of the web, a component transversely of such direction and/or a component in directions up and down (i.e., toward and away from the path of the web). Furthermore, the lamp or lamps 44 can be caused to pivot relative to their carriages while the carriages move along the guide means in the housing 30. Still further, the extent of movement of the lamp or lamps transversely of the path of the web (as shown in FIGS. 7 and 8) can be such that radiation issuing from such lamp or lamps bypasses the web when the carriage or carriages reach their end positions. The controls for the means for moving the lamp or lamps can be designed to automatically turn off the lamp or lamps when the web comes to a halt. Alternatively, the lamp or lamps can be turned off by suitable time-delay devices when the length of the interval of dwell of the web exceeds a preselected threshold value. Still further, it is possible to design the means for moving the lamp or lamps 44 in such a way that the lamps are automatically moved out of the way (i.e., to positions in which the radiation does not impinge upon the web) as soon as the web comes to a halt or as soon as the length of the interval of idleness of the web exceeds the aforementioned threshold value. FIG. 8 shows that radiation issuing from the lamp 44 which is shown therein bypasses the path of the web 1 when the limit switch 59 is actuated.

An important advantage of the improved apparatus is that a continuously or intermittently moving web can be dried by a small number of ultraviolet lamps, e.g., by a single lamp. This is due to the fact that the apparatus employs one or more mobile lamps, i.e., that it comprises means for moving the lamp or lamps relative to the path of movement of the web. Moreover, the movements of the lamp or lamps can be caused to conform to the extent of intermittent movement of the web from the printing machine toward the takeup reel, i.e., the length of strokes of the lamp or lamps in the directions indicated by the arrow A can match the distances which are covered by the web 1 during one of its intermittent advances. Still further, the improved apparatus ensures highly satisfactory polymerization of polymerizable materials if such materials are applied to the web in a printing or other treating machine.

In many instances, the path of movement of the lamp or lamps is parallel to the path of movement of the web, i.e., the distance between the lamp or lamps on the one hand and the web on the other hand can remain at least substantially unchanged. This contributes to more uniform treatment of the web in the improved apparatus. As shown in FIG. 3, the path of the web need not be horizontal but can have a vertical component. Also, the entire path of the web can be a vertical path if the space which is available for the apparatus is such that the supply and takeup reels must be located at different levels. The path of the web 1 can be a straight but inclined path, e.g., a path which makes a relatively small acute angle with the horizontal. The guide means for the carriage or carriages can define one or more straight, arcuate, meandering or otherwise configurated paths. Moreover, the guide means need not necessarily comprise rails; for example, the carriage or carriages can be caused to advance along cables. All such modifications will be readily comprehended without additional illustrations.

Another important advantage of the improved apparatus is that it can operate properly with a single lamp or with a small number (e.g., two or three) of lamps. This greatly reduces the initial and maintenance cost of the apparatus and further reduces the likelihood of uneven drying of the material because the number of regions where the beams of radiation issuing from discrete lamps overlap each other is small or zero. The uniformity of drying and polymerizing action is especially pronounced if the apparatus employs a single lamp. The intervals of idleness of the apparatus are also reduced because only a single lamp or only one of a small number of lamps may require replacement. Moreover, the action of a single lamp or a small number of lamps is uniform or substantially uniform regardless of the length of strokes of the material if such material is advanced intermittently rather than continuously. Still further, the lamp or lamps of the improved apparatus need not necessarily be moved away from register with the path of advancement of the material to be dried because such lamp or lamps are in motion and, therefore, the concentration of radiation upon any given portion of the material is not likely to be excessive. As a rule, the lamp or lamps will be turned off or moved away from a position of register with the path for the material to be treated only if the material is maintained at a standstill for extended intervals of time.

An advantage of the cooling device is that the material of the web or sheet is cooled in the course of the drying operation. Thus, heat which is generated by one or more ultraviolet lamps acts upon the substance or substances which are applied to the upper side of the material of the web or sheet in a printing or like machine but the heat cannot affect the condition of the material. At the present time, cooling devices which come in direct contact with the material of a web or sheet are preferred because they are more efficient and less expensive. Moreover, the surface of a plate-like cooling member reduces the likelihood of fluttering, wrinkling and/or other deformation of the material of a web or sheet which is in the process of advancing through or dwells at the drying station.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for drying moisture-containing sheet-like materials, particularly for drying coated or impregnated webs of paper, textile material and the like, comprising means for advancing a material to be dried along a predetermined path and in a predetermined direction; at least one source of ultraviolet radiation adjacent to one side of said path; and means for moving said source with reference to said path, said moving means including a carriage for said source, an arcuate guide for said carriage, and means for reciprocating said carriage along said guide.

2. The apparatus of claim 1, wherein said moving means is arranged to reciprocate said source in and counter to said predetermined direction.

3. The apparatus of claim 1, wherein said moving means is arranged to move said source along a second path which is at least substantially parallel to said predetermined path.

4. The apparatus of claim 1, further comprising means for treating the material ahead of said source, as considered in said direction, said treating means comprising a printing machine such as a screen printing machine.

5. The apparatus of claim 1, wherein said advancing means includes means for intermittently transporting the material through first distances and said moving means is designed to move said source through second distances each of which at least approximates one of said first distances.

6. The apparatus of claim 1, further comprising a housing adjacent to said one side of said path and having an open side facing said path, said source being installed in the interior of and being movable with reference to said housing.

7. The apparatus of claim 6, wherein said housing has a portion adjacent to said open side and provided with a passage for the material to be dried.

8. The apparatus of claim 1, wherein said reciprocating means includes a prime mover having an output element, and a crank mechanism interposed between said output element and said source.

9. The apparatus of claim 1, wherein said reciprocating means comprises a fluid-operated motor.

10. The apparatus of claim 9, wherein said motor includes a pneumatic cylinder and piston unit.

11. The apparatus of claim 1, wherein said reciprocating means includes a lever pivotable about a predetermined axis and having an arm connected with said source, and means for pivoting said lever.

12. The apparatus of claim 1, further comprising means for cooling the material, said cooling means being adjacent to the other side of said path.

13. The apparatus of claim 12, wherein said source is disposed at a level above and said cooling means is disposed at a level below said path.

14. The apparatus of claim 12, wherein said cooling means includes a material contacting cooling surface disposed opposite said source.

15. The apparatus of claim 12, wherein said cooling means includes at least one cooling element having means for exerting a directed cooling action upon that side of the material in said path which faces away from said source.

16. The apparatus of claim 12, wherein said cooling means comprises a cooling member which is in direct contact with the material in said path, and at least one device for removing heat from said cooling member.

17. The apparatus of claim 16, wherein said heat removing device includes a heat exchanging coil.

18. The apparatus of claim 16, wherein said heat removing device comprises a blower.

19. The apparatus of claim 16, wherein said cooling member includes a plurality of profiles having aligned material contacting surfaces and said device includes heat exchanging coils in said profiles.

20. The apparatus of claim 12, wherein said cooling means includes a suction chamber having an apertured wall contacting the material in said path.

21. The apparatus of claim 12, wherein said cooling means includes at least one heat exchanging coil.

22. The apparatus of claim 12, wherein said cooling means comprises at least one blower.

23. The apparatus of claim 1, wherein said advancing means includes a plurality of rolls and the material is trained over such rolls, at least one of said rolls having an evacuated space and a foraminous material-contacting wall surrounding said evacuated space.

24. The apparatus of claim 1, wherein said advancing means includes means for continuously transporting the material past said source.

25. The apparatus of claim 1, wherein said advancing means includes means for intermittently transporting the material past said source.

26. The apparatus of claim 1, wherein said reciprocating means includes a cylinder and piston unit for moving said source relative to said predetermined path.

27. Apparatus for drying moisture-containing sheet-like materials, particularly for drying coated or impregnated webs of paper, textile material and the like, comprising means for advancing a material to be dried along a predetermined path and in a predetermined direction; at least one source of ultraviolet radiation adjacent to one side of said path; means for moving said source with reference to said path, said moving means including a carriage for said source, an arcuate guide for said carriage, and means for reciprocating said carriage along said guide; and means for cooling the material, said cooling means being adjacent to the other side of said path, and said cooling means having an arcuate surface whose curvature at least approximates that of said guide and which contacts the material opposite said source.

28. The apparatus of claim 27, wherein said surface is a convex surface at least a portion of which forms part of a cylindrical surface.

* * * * *